US011346070B2

(12) United States Patent
Shevtsov et al.

(10) Patent No.: US 11,346,070 B2
(45) Date of Patent: May 31, 2022

(54) PILE-DRIVING DEVICE AND METHOD FOR DRIVING INTO A GROUND

(71) Applicant: BAUER Maschinen GmbH, Schrobenhausen (DE)

(72) Inventors: Dimitri Shevtsov, Augsburg (DE); Robert Kulzinger, Hollenbach (DE); Stefan Zepmeisel, Baar-Ebenhausen (DE); Josef Stockl, Holzheim (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 54 days.

(21) Appl. No.: 16/806,624

(22) Filed: Mar. 2, 2020

(65) Prior Publication Data

US 2020/0283981 A1 Sep. 10, 2020

(30) Foreign Application Priority Data

Mar. 6, 2019 (EP) ..... 19161108

(51) Int. Cl.

| | |
|---|---|
| ***E02D 7/06*** | (2006.01) |
| ***E02D 7/08*** | (2006.01) |
| ***E02D 7/18*** | (2006.01) |
| ***E02D 13/04*** | (2006.01) |

(52) U.S. Cl.

CPC ..... *E02D 7/08* (2013.01); *E02D 7/18* (2013.01); *E02D 13/04* (2013.01); *E02D 7/06* (2013.01)

(58) Field of Classification Search

CPC .... E02D 7/18; E02D 7/20; E02D 7/14; E02D 7/02; E02D 7/06; E02D 11/00; E02D 13/00

USPC ..... 405/231, 232

See application file for complete search history.

(56) References Cited

U.S. PATENT DOCUMENTS

| | | | |
|---|---|---|---|
| 4,653,595 | A | 3/1987 | Hebert |
| 5,332,047 | A | 7/1994 | Hignite |

FOREIGN PATENT DOCUMENTS

| | | | |
|---|---|---|---|
| DE | 9318190 | U1 | 1/1994 |
| DE | 20203336 | U1 | 5/2002 |
| DE | 102010023216 | A1 | 1/2012 |

OTHER PUBLICATIONS

European Search Report issued in EP 19 161 108.6; dated Jul. 11, 2019.

An Office Action mailed by China National Intellectual Property Administration dated Jun. 2, 2021, which corresponds to Chinese Patent Application No. 202010152503.6 and is related to U.S. Appl. No. 16/806,624; with English language translation.

*Primary Examiner* — Sunil Singh

(74) *Attorney, Agent, or Firm* — Studebaker & Brackett PC

(57) ABSTRACT

The invention relates to a pile-driving device and a method for driving driving material into a ground, wherein, for the purpose of driving-in, the driving material is clamped and held by means of a clamping means on a pile-driving power unit and prior to clamping the driving material is connected by means of a flexible securing element, in particular a securing chain, to the pile-driving power unit. In accordance with the invention a pressing element is provided which is displaced relative to the pile-driving power unit towards the driving material and, in doing so, a pressing force is applied onto an upward-directed front face of the driving material.

16 Claims, 10 Drawing Sheets

PILE-DRIVING DEVICE AND METHOD FOR DRIVING INTO A GROUND

Figure 1:
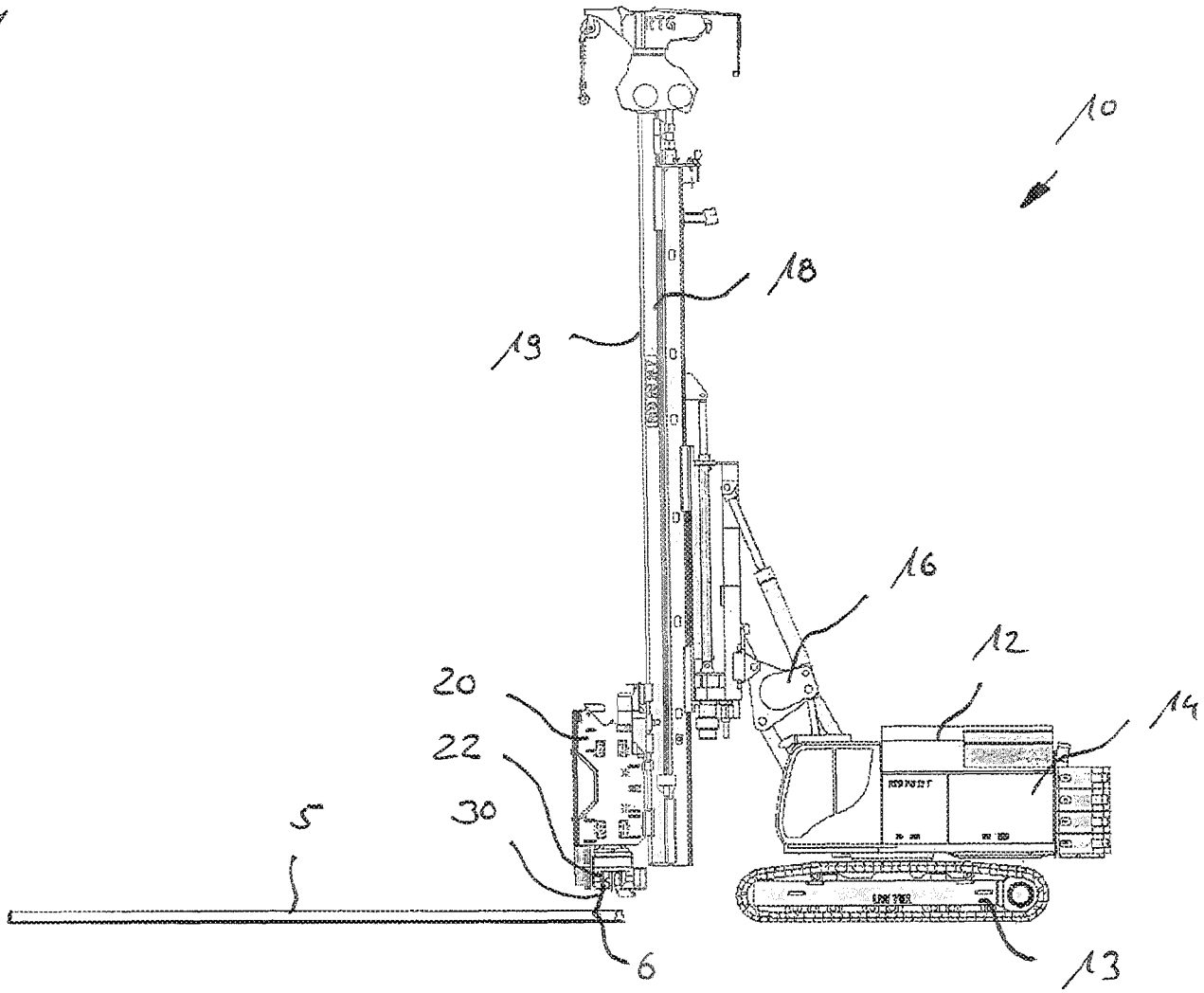

The invention relates to a pile-driving device for driving a driving material into a ground, having a pile-driving power unit which is arranged in a vertically movable manner and has a clamping means for clamping and holding the driving material, and a flexible securing element, in particular a securing chain, with which the driving material can be connected to the pile-driving power unit prior to clamping, in accordance with the preamble of claim 1.

The invention furthermore relates to a method for driving or extracting driving material into or from a ground, wherein, for the purpose of driving-in, the driving material is clamped and held by means of a clamping means on a pile-driving power unit and the driving material is connected by means of a flexible securing element, in particular a securing chain, to the pile-driving power unit, in accordance with the preamble of claim 9.

A generic pile-driving device and a generic method can be taken from DE 36 02 609 A1. In this known method a sheet pile that is e.g. in a horizontal arrangement on the ground is initially loosely fixed on a vibration means using a chain anchoring. A securing chain is guided through a through-hole in the upper end region of the pile and fixed on a vibration means. Through upward movement of the vibration means along a mast the sheet pile is held by the chain anchoring and pulled upwards until it is directed approximately perpendicularly and suspended on the securing chain. Afterwards, the vibration means is moved downwards by a certain amount until a lower end of the sheet pile rests on the ground and an upper end of the sheet pile enters a receiving slot of the vibration means between two clamping jaws. Subsequently, the sheet pile is clamped on the vibration means between the two clamping jaws so that the clamped sheet pile can then be driven or impact-driven vertically into the ground using the vibration means. In this process, however, it can happen that the sheet pile tilts from the vertical before being received in the receiving slot.

On completion of a foundation construction measure it is often necessary or desired that the sheet piles are taken out of the ground again. For this purpose, use can also be made of the known pile-driving device, in which case prior to the extraction of the sheet pile the securing chain is also guided through a through-opening on the sheet pile and thus the sheet pile is additionally secured on the vibration means. Beforehand or afterwards, the upper end of the pile is clamped again and extracted by way of vibration from the ground using the vibration means. In this, the securing chain serves as an additional mechanical fall protection to prevent the pile from falling uncontrollably to the ground e.g. in the case of failure of the hydraulic clamping means.

A similar arrangement of a pile-driving device is known from U.S. Pat. No. 5,332,047. In this known device a pile-shaped driving material is driven into the ground, in which case a securing chain can also be arranged between driving material and the pile-driving device. Due to the variety of different shapes and dimensions of the driving material, especially in the case of sheet piles, adaptation to the respective size can be problematic.

From DE 10 2010 023 216 A1 a pile-driving device with a hammer head can be taken, in which a gripper for gripping the pile-shaped driving material is additionally provided. The gripper comprises two gripping claws, with which a driving material can be clamped and held along lateral edges.

The invention is based on the object to provide a pile-driving device for driving a driving material into a ground and a related method, with which a particularly efficient and secure handling of the driving material is rendered possible.

In accordance with the invention the object is achieved by a pile-driving device having the features of claim 1 and by a method having the features of claim 9. Preferred embodiments of the invention are stated in the dependent claims.

The pile-driving device according to the invention is characterized in that a pressing element is provided which is supported in a displaceable manner relative to the pile-driving power unit and designed for applying a pressing force onto an upward-directed front face of the driving material prior to clamping. Due to the fact that the pressing element acts onto an upward-directed front face of the driving material the position and dimensioning of the pressing element are largely independent of the lateral dimensions of the driving material and do not have to be specifically adapted when the driving material is changed.

By way of the invention a particularly secure handling of driving material is rendered possible. In particular, the invention prevents accidents at work, in which improperly secured or incorrectly clamped driving material disengages itself from the pile-driving power unit and falls to the ground. Disengaged and falling sheet piles that can have a length of over 10 m and a weight of up to a ton and more can lead to severe accidents on construction sites involving personal injury and material damage.

According to the invention a secure clamping of the driving material in the clamping means is ensured. The invention is based on the finding that during hoisting of the driving material the flexible securing element is tensioned until the driving material is vertically aligned and placed onto the ground. When the pile-driving power unit is moved downwards and an upper end of the driving material is introduced into the clamping means, the tension on the flexible securing element is removed. Hence, until being brought into the clamping position on the clamping means there is no positional securing of the vertically directed driving material for a certain period of time that may last a few seconds. The said driving material can then tilt from the vertical position and thereby hinder or entirely prevent correct introduction into the clamping means. In fact, the tilting driving material can be caught by the flexible securing element. However, the driving material then has to be aligned once more through upward movement of the pile-driving power unit and the threading process into the clamping means has to be repeated which means additional expenditure of time. Moreover, when catching the tilting driving material the flexible securing element is exposed to considerable stress and corresponding wear. In the case of insufficient maintenance of a securing chain for example there is the risk that it breaks and the driving material falls over uncontrollably.

According to the invention a pressing element is provided which is supported in a displaceable manner relative to the pile-driving power unit. Hence, before releasing the tension of the flexible securing element the pressing element can be moved towards the driving material and, prior to clamping by means of the clamping means, hold this in a vertical position by applying a defined pressing force when the pile-driving power unit moves downwards for clamping. The driving material can thus be reliably held in a vertical position. In this vertical position a secure introduction of the driving material into the clamping means is rendered possible through a simple downward movement of the pile-driving power unit. This allows for an efficient and secure clamping of the driving material on the pile-driving power unit without the securing element being exposed to enormous stress.

A preferred embodiment of the invention resides in the fact that the pressing element is designed with a passage, through which clamping of the driving material by the clamping means is enabled when the pressing element is in abutment. Hence, the pressing element does not cover the entire upper region of the driving material. In fact, by way of the passage a partial region of the driving material remains uncovered, in which the driving material is then clamped on the pile-driving power unit by means of the clamping means that has at least one movable clamping jaw.

Basically, the pressing element can be of any chosen design in order to accomplish this function. A preferred embodiment resides in the fact that the pressing element is of fork-shaped design. By way of a fork-shaped pressing element it is possible that, almost irrespective of size and shape of the driving material, a driving material, in particular a sheet pile, can be reliably pressed in its external regions downwards by a vertical force while the clamping means can reliably clamp the driving material in a center region on the upper end thereof.

In a further development of the invention the pressing element is designed such that in addition to the displacement capability of the entire pressing unit the pressing arms pressing onto the driving material are also adjustable in a horizontal plane, allowing the upper end of the driving material to be turned and/or displaced horizontally. This enables particularly easy and reliable alignment of the driving material such that the clamping means of the pile-driving power unit can move above the said driving material and reliably clamp this. For this, the invention makes use of the finding that long driving material such as a sheet pile that can have a length of 10 m or even more is in itself of such flexibility that the upper end can also be turned or shifted if the lower end is pressed onto the ground and, to some extent, fixed in position. Thus, the clamping process takes place in a rapid, secure and reliable way, whereby an efficient operation is rendered possible.

To exert the required pressing force the pressing element can basically be moved in any suitable way towards the driving material and pressed thereon. According to a further development pursuant to the invention it is especially expedient that the pressing element is displaceable by means of a positioning cylinder which is arranged between the pile-driving power unit and the pressing element. By preference, the positioning cylinder is driven hydraulically and designed, in particular, as a double-acting hydraulic cylinder.

The pressing element can be displaceably supported in any chosen manner. According to a variant pursuant to the invention it is especially advantageous for the pressing element to be displaceable along a linear guide which is arranged on a mast or the pile-driving power unit. When arranged on a vertical mast the pressing element can in particular be displaceable along the same linear guide, along which a working sledge of the pile-driving power unit is also displaceable along the mast. Alternatively, on the pile-driving power unit itself a linear guide can be designed which is directed downwards and along which the pressing element is supported in a displaceable manner. In this case the linear guide can preferably be designed by way of one or several cylinder guides. Such a linear guide on the pile-driving power unit proves to be particularly expedient if the pile-driving power unit is freely suspended on a rope.

The pile-driving power unit serves the purpose of driving a driving material, in particular a pile, a beam or a sheet pile, by means of vibrations or pulses into a ground. For this, it is preferred that the pile-driving power unit is designed as a vibrator with rotatable imbalance elements or as a pile-driving hammer with a pulse element capable of being driven in a linearly reversible manner. The vibrator can have one or several pairs of rotatable imbalance elements which, for the purpose of generating a directed imbalance force, are adjustably supported with respect to each other in a known manner. Alternatively, the pile-driving power unit can be a pile-driving hammer. Here, the driving movement can cause impact pulses, in which the reversibly driven pulse element strikes an impact surface. Alternatively, the pulse element can also be driven in a reversible manner without impact contact so that a targeted vibratory movement is generated and transmitted to the driving material.

According to a further development of the invention an increase in operational safety is achieved in that a test unit is provided which is designed to establish that the flexible securing element is attached between the driving material and the pile-driving power unit. This test unit, by establishing in particular an electrical contact, can determine as early as before movement of the driving material if the flexible securing element is connected in particular to one or two anchoring points on the pile-driving power unit. Especially when extracting a driving material from the ground it is ensured that this process does not take place without additional mechanical securing of the driving material on the pile-driving power unit.

In a further embodiment of the pile-driving device according to the invention it is advantageous that a mobile carrier implement is provided, on which the mast is arranged. In particular, the carrier implement can have a crawler-track running gear, on which a rotatable upper carriage with a vertical mast, especially a telescopic leader or a boom with support rope, is supported.

The method according to the invention is characterized in that a pressing element is provided which is displaced relative to the pile-driving power unit towards the driving material and, in doing so, a pressing force is applied onto an upward-directed front face of the driving material.

The method according to the invention can be carried out, in particular, by way of the previously described pile-driving device. The advantages described beforehand can be achieved thereby.

A preferred method variant of the invention resides in the fact that the driving material is held by the pressing element in a clamping position, in that subsequently the pile-driving power unit is moved towards the driving material and in that the driving material is clamped by means of the clamping means and held on the pile-driving power unit for driving-in Through the pressing element a pressing force is applied onto the driving material so that this is fixed in the vertical position and cannot tilt over before the flexible securing element is detached or tension-released. In this position an efficient, secure and careful clamping of the driving material by the clamping means can then take place when the clamping means has moved into position through downward movement of the pile-driving power unit. Subsequently, driving-in can take place.

This method is developed further in a preferred manner in that subsequently, for driving-in, the pressing element is released and spaced apart from the driving material. In particular, the pressing element can be moved by a positioning cylinder from the pressing position back into a standby position, in which the pressing element is spaced apart from the driving material. Afterwards, the pile-driving power unit can be put into operation so that the driving material can then be driven into the ground without direct stress being exerted onto the pressing element.

According to a further development of the method pursuant to the invention it is preferred that by means of the pressing element a position of the driving material is adjusted and brought into a clamping position. In this, the pressing element can itself be adjustable transversely to the vertical displacement axis into one or several directions of movement, thus allowing a certain alignment of the driving material by the pressing element. Alternatively, on the pressing element itself various adjustable parts or sections can be arranged that can be adjusted with respect to a base carrier of the pressing element for alignment of the driving material.

Another advantageous method variant of the invention resides in the fact that with pressing force being applied by the pressing element onto the driving material, the pile-driving power unit assumes a test position, in which the flexible securing element between the driving material and the pile-driving power unit is tensioned, and in that a test unit establishes if the flexible securing element is located between the driving material and the pile-driving power unit in the test position.

In this method variant it can be automatically established by the pile-driving device if the flexible securing element, in particular a securing chain, is attached between driving material and the pile-driving power unit for additional positional securing and accident protection. If the driving material is held in a vertical position by the pressing element, the pile-driving power unit can be moved upwards in this position and the flexible securing element, which is fixed on the one hand on the driving material and on the other hand on the pile-driving power unit, can be tensioned. If the securing element is properly fixed, during upward movement of the pile-driving power unit a tensile force will build up by the tensioned flexible securing element between the pressing element that holds the driving material in the vertical position and the pile-driving power unit. This can be established e.g. by a pressure or force measuring means located on the pressing element, a positioning cylinder of the pressing element or the pile-driving power unit for example.

On reaching a certain tensile force value it can thus be reliably established by a test or evaluation unit that the flexible securing element is properly fixed. If, however, such a tensile force is not established this can be considered as an indication that the flexible securing element is not fixed or improperly fixed. Testing can be implemented by the test unit before driving-in or before or after extraction of the driving material. During testing a defined test force is applied, by which the flexible securing element is not overstressed.

According to an embodiment variant of the method pursuant to the invention provision is made in that the test unit issues a warning signal if it is established that no flexible securing element is located between the driving material and the pile-driving power unit. The warning signal can in particular be issued optically and/or acoustically to a machine operator or also to the surrounding region of the pile-driving device. In particular, in such a case the driving material is held by the clamping means which is blocked in the clamped state.

According to a further development of the invention it is preferred that the test unit prevents driving-in or extraction of the driving material if it is established that no flexible securing element is located between the driving material and the pile-driving power unit. Driving-in can only be continued when the missing securing element is attached for example. In particular, in case of a missing flexible securing element the pressing force onto the driving material can be maintained until, following a predetermined safety procedure, adequate positional securing of the driving material is ensured or a potential danger zone by unsecured driving material is cleared of persons.

Figure 2:
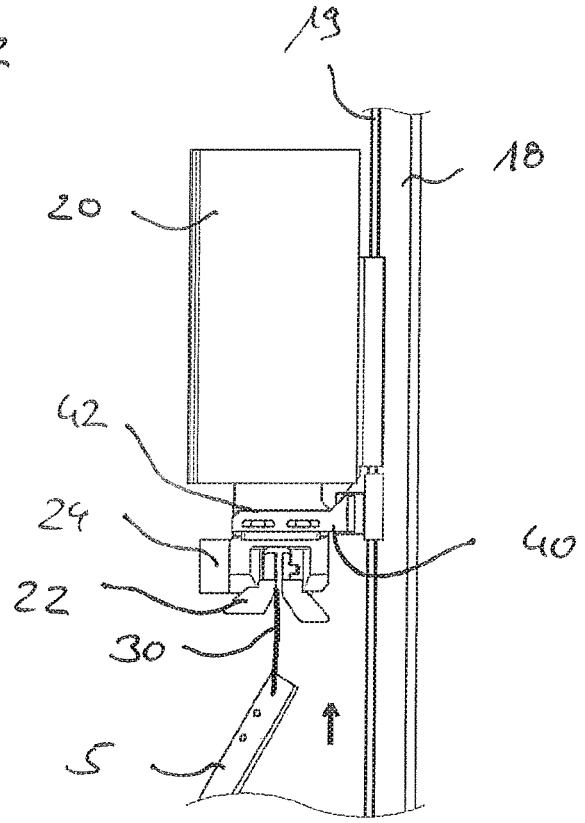
Figure 3:
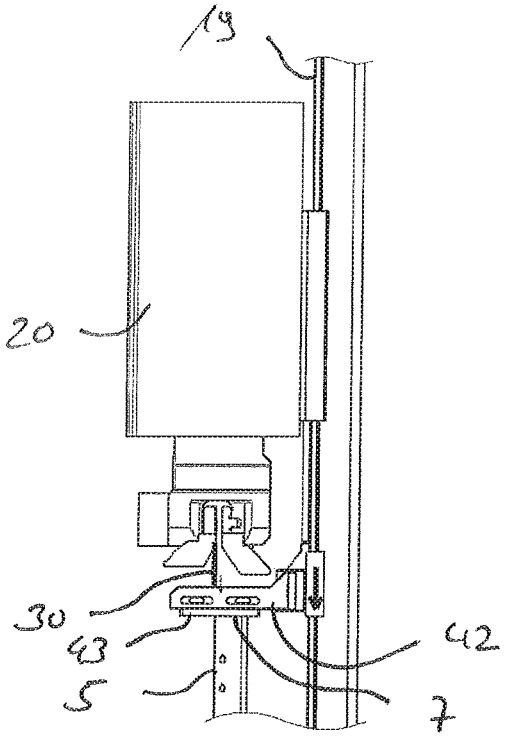
Figure 4:
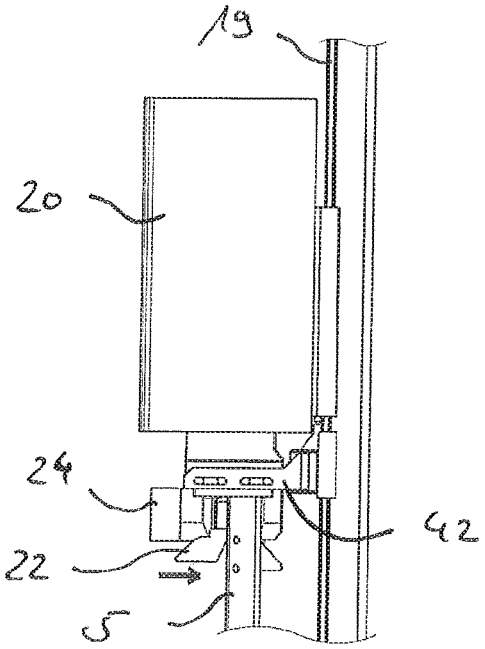
Figure 5:
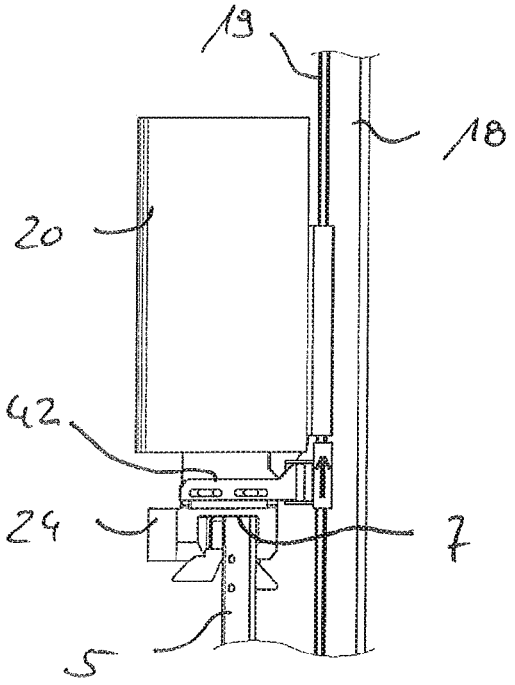
Figure 6:
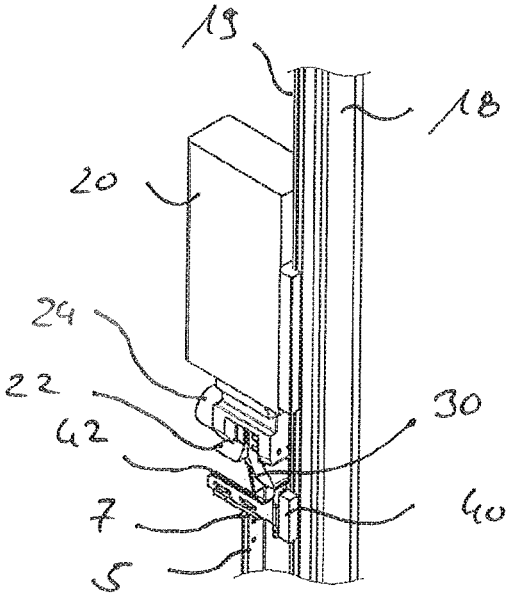
Figure 7:
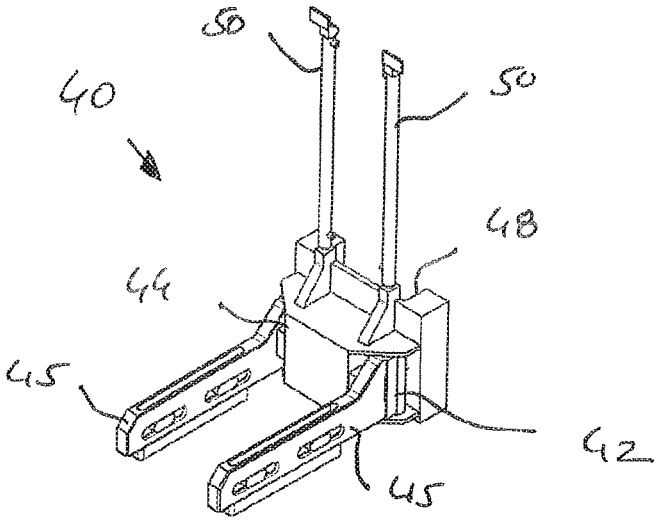
Figure 8:
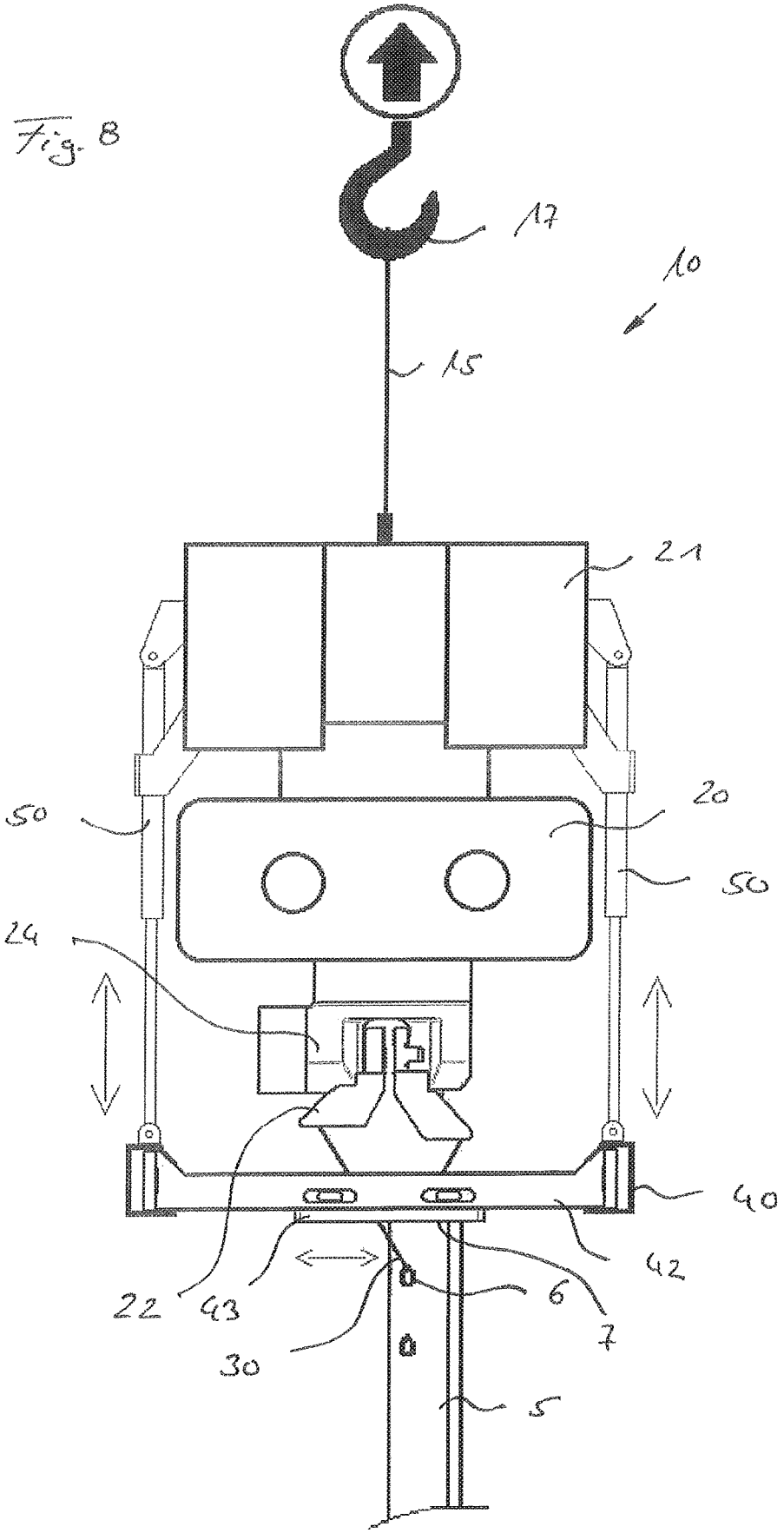
Figure 9:
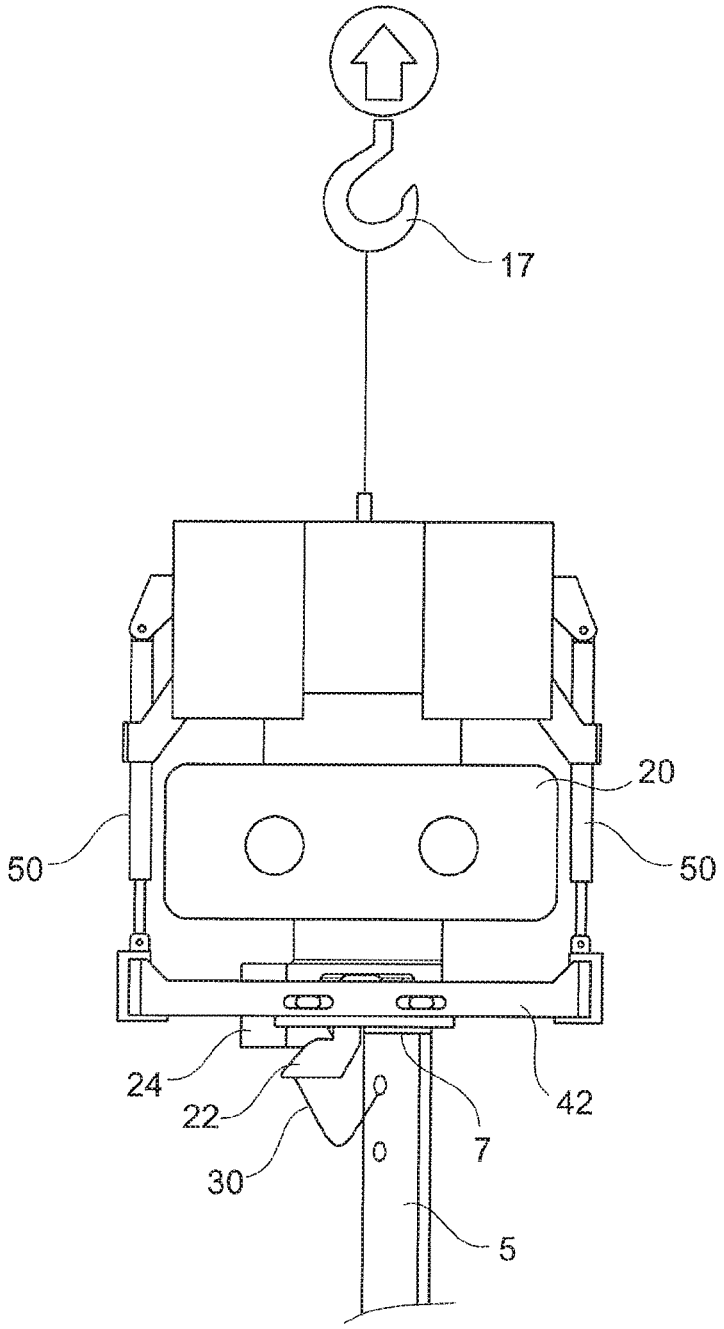
Figure 10:
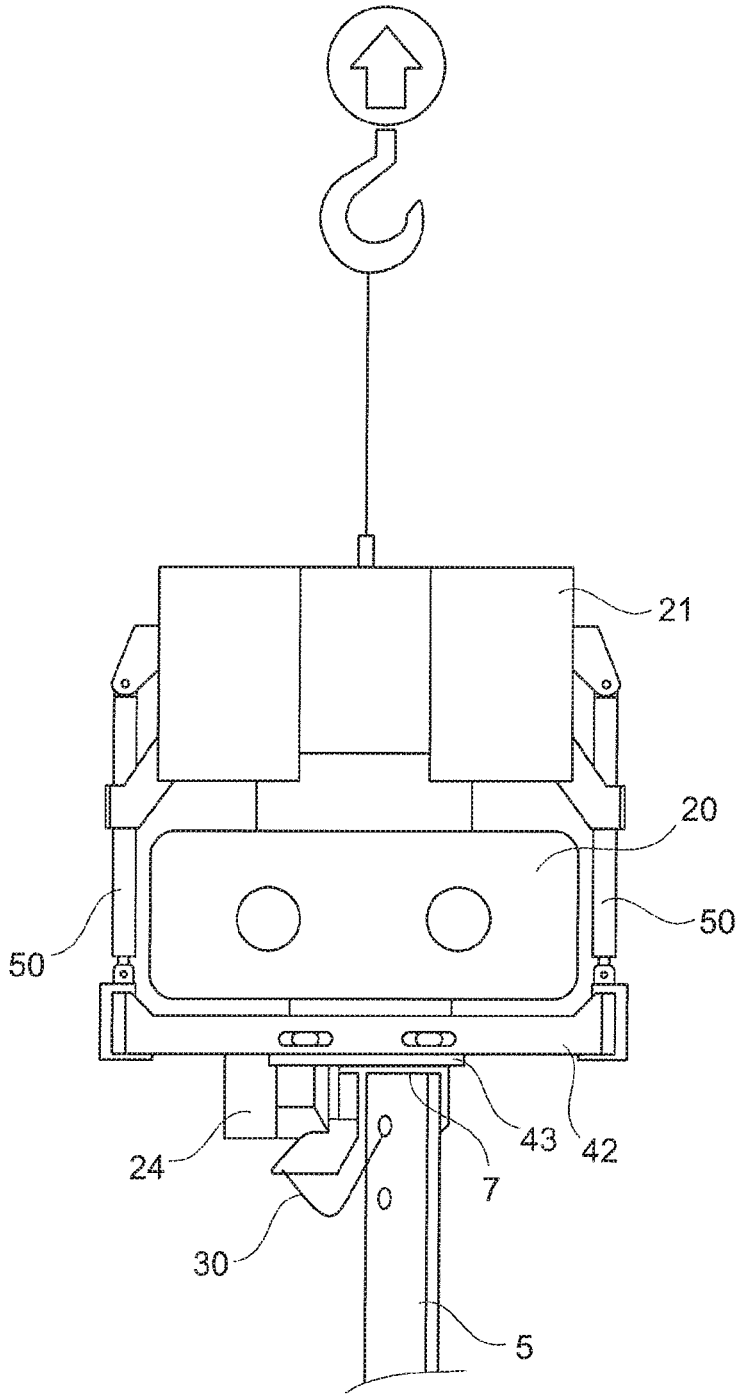

The invention is described further hereinafter by way of preferred embodiments illustrated schematically in the drawings, wherein show:

FIG. 1 a schematic side view of a pile-driving device with vertical mast when receiving a driving material;

FIG. 2 a schematic detailed view of a pile-driving device according to the invention when hoisting the driving material;

FIG. 3 a schematic detailed view of the pile-driving device of FIG. 2 and pursuant to the invention with vertically arranged driving material;

FIG. 4 a schematic detailed view of the pile-driving device of FIGS. 2 and 3 when clamping the driving material;

FIG. 5 a schematic detailed view of the pile-driving device according to FIGS. 2 to 4 when releasing the pressing element;

FIG. 6 a schematic perspective view of the pile-driving device pursuant to the invention and according to FIGS. 2 to 5 in a test position;

FIG. 7 an enlarged perspective detailed view of a pressing unit according to the invention;

FIG. 8 a schematic side view of a further pile-driving device according to the invention with rope suspension of the pile-driving power unit;

FIG. 9 the pile-driving power unit of FIG. 8 when clamping the driving material and with the pressing element being in abutment; and FIG. 10 the pile-driving power unit of FIG. 9 with withdrawn pressing element.

The basic construction of a pile-driving device 10 is explained in conjunction with FIG. 1. The pile-driving device 10 has a mobile carrier implement 12 that comprises a crawler-track running gear 13. On the crawler-track running gear 13 an upper carriage 14 is supported in a rotatable manner. The upper carriage 14 has, in a manner generally known, an operator's cab as well as the power units of the pile-driving device 10. A mast 18 which is designed as a telescopic leader in the illustrated embodiment is supported in an adjustable manner on the upper carriage 14 by way of an adjustment mechanism 16. On a front side of the mast 18 directed in a substantially vertical manner a linear guide 19 is arranged, along which a pile-driving power unit 20 is supported in a linearly displaceable manner. In the illustrated embodiment the pile-driving power unit 20 is designed as a vibrator, in the housing of which rotationally driven imbalance elements are supported.

To receive a driving material 5, which can be a sheet pile or a steel beam in particular, the pile-driving power unit 20 is displaced along the mast 18 into a lower receiving position illustrated in FIG. 1. By means of a flexible securing element 30, which is a securing chain in particular, the driving material 5 is initially connected to a receiving part 22 at the lower end of the pile-driving power unit 20. The flexible securing element 30 can be guided through a securing hole 6 on the driving material 5. The flexible securing element 30 is secured on the receiving part 22 in a generally known manner by a lock.

To hoist and clamp the pile-shaped driving material 5 the pile-driving power unit 20 is displaced upwards along the mast 18 with the linear guide 19 via a non-depicted rope drive or a hydraulic cylinder, as illustratively depicted in FIG. 2. Due to the connection of the driving material 5 to the receiving part 22 of the pile-driving power unit 20 via the flexible securing element 30 the driving material 5 is raised from the horizontal position according to FIG. 1 and pulled into a vertical position. On the receiving part 22 a clamping means 24 with at least one hydraulically adjustable clamping jaw is located in a generally known manner. Furthermore, in the lower region of the pile-driving power unit 20 a pressing unit 40 according to the invention having a pressing element 42 in a standby or withdrawn position is arranged in accordance with the invention. In this standby position the pressing element 42 is located above the receiving part 22 and the clamping means 24.

The upward movement of the pile-driving power unit 20 with the suspended driving material 5 takes place until the bar-shaped driving material 5 has been hoisted or erected vertically, with a lower end of the driving material 5 resting on the ground. In this position illustrated in FIG. 3 the schematically depicted flexible securing element 30 between the erected vertical driving material 5 and the pile-driving power unit 20 is tensioned. In this position with a tensioned flexible securing element 30 the vertical position of the driving material 5 is secured. To maintain this secured position, according to the invention the pressing element 42 of the pressing unit 40 is displaced downwards relative to the pile-driving power unit 20 by means of non-depicted positioning cylinders until lower contact sections 43 of the pressing element 42 abut against an upper front face 7 of the driving material 5 and thereby press the driving material 5 with a defined pressing force downwards against the ground. In this position the vertically directed driving material 5 is positionally secured by the pressing element 42 abutting under pressure, as shown in FIG. 3. This positional securing or fall protection is independent of a width or lateral contour of the driving material 5.

With the pressing element 42 abutting against the driving material 5, as illustrated in FIG. 4, the pile-driving power unit 20 can now be displaced downwards relative to the pressing element 42, whereby an upper end region of the driving material 5 is introduced into the receiving part 22 with the inclined introduction surfaces. Subsequently, by way of a hydraulic clamping cylinder of the clamping means 24 that is directed transversely to the vertical direction the driving material 5 can be clamped firmly on the pile-driving power unit 20. During downward movement of the pile-driving power unit 20 along the linear guide 19 the tension of the flexible securing element 30 is released, while the driving material 5 is still held in the vertical position by the pressing element 42 abutting under pressure. All in all, in accordance with the invention a reliable introduction of the driving material 5 into the receiving part 22 and a clamping by the clamping means 24 of the pile-driving power unit 20 can thus take place.

According to FIG. 5 the pressing element 42 can now be displaced again along the linear guide 19 of the mast 18 in the upward direction relative to the pile-driving power unit 20 and thus be released from the upper front face 7 of the driving material 5. In doing so, the driving material 5 is still clamped by the clamping means 24 of the pile-driving power unit 20 and thereby fixed in position. After the fork-shaped pressing element 42 has been spaced apart from the driving material 5 by moving back into the withdrawn standby position the actual pile-driving process can now commence. In this, the rotating imbalance units inside the pile-driving power unit 20 are set into rotation in a generally known manner, whereby a targeted, downward-directed imbalance force is generated. Through simultaneous downward movement of the pile-driving power unit 20 the elongated driving material 5 can thus be driven into the ground. Following driving into the ground the flexible securing element 30 is detached again from the driving material 5 so that new driving material 5 can then be received by the pile-driving device 10 and the pile-driving process can be repeated.

Conversely, by means of the pile-driving device 10 an extraction of the driving material 5 from the ground can also be carried out. In this process, an upper end of the driving material 5 projecting from the ground is clamped by the clamping means 24 of the pile-driving power unit 20, wherein for reasons of work safety the flexible securing element 30 is attached simultaneously or with a time lag between the receiving part 22 of the pile-driving power unit 20 and the driving material 5. In particular by generating targeted vibrations it is thus possible through upward movement of the pile-driving power unit 20 that the driving material 5 is reliably extracted from the ground. Afterwards, the clamping means 24 is released so that the driving material 5 is again solely connected via the flexible securing element 30 to the pile-driving power unit 20.

For reasons of work safety, it is essential that during the release of the clamping means 24 certainty prevails that the driving material 5 is in fact still secured via the flexible securing element 30 to the pile-driving power unit 20, as illustratively depicted in FIG. 6.

To reliably verify this provision is made in the pile-driving device 10 according to the invention for a non-depicted test unit. By way of this, before release of the clamping means 24, the fork-shaped pressing element 42 of the pressing unit 40 is displaced relative to the pile-driving power unit 20 in the downward direction from the withdrawn standby position until the pressing element 42 abuts against the upper front face 7 of the driving material 5. Through this, the pressing element 42 exerts a defined retention force onto the driving material 5 in the downward direction so that this is secured in the vertical position. The clamping means 24 can now be released and the pile-driving power unit 20 can be displaced upwards by a defined distance and/or with a defined retraction force until the flexible securing element 30 reaches a tensioned state again. In case of a properly attached flexible securing element 30 a defined tension builds up in this process which can be established by means of the test unit.

If a corresponding tension is present this is a clear indication that the flexible securing element 30 is properly attached and the driving material 5 is thus reliably connected via the flexible securing element 30 to the pile-driving power unit 20. If the tension or tensile force is not established by the test unit, this may be an indication that a correct securing of the driving material 5 by the flexible securing element 30 is not ensured. A warning signal can then be issued by the test unit and a securing procedure or a blockage of the further operation can be carried out. In particular, in such a case the pressing element 42 remains pressed against the front face 7 of the driving material 5 in order to secure the driving material 5 in the vertical position until, for example, adequate additional securing is attached between the pile-driving power unit 20 and the driving material 5.

As a matter of course, this verification can also be carried out as early as before extraction of a driving material located in the ground.

The pressing unit 40 according to the invention with the pressing element 42 is illustrated in greater detail in FIG. 7.

The pressing element 42 has a base body 44 with two parallel pressing arms 45. In this way, the pressing element 42 is formed in the shape of a fork, with a central passage 46 being formed between the two parallel pressing arms 45. The passage 46 permits clamping of the driving material by the clamping means on the pile-driving power unit which can pass through the pressing element 42 along the passage 46.

By preference, the two pressing arms 45 are pivotably supported about a vertical axis on the base body 44. Moreover, on their undersides the pressing arms 45 have contact sections 43 for contacting the driving material. The contact sections 43 are preferably supported in a shiftable manner along the pressing arms 45. On a rear side of the base body 44 of the pressing element 42 a guide shoe 48 is designed which interacts with the linear guide 19 on the mast 18.

In FIG. 7 two positioning cylinders 50 are also indicated schematically, with which the pressing element 42 can be displaced with respect to the pile-driving power unit 20, wherein by means of the positioning cylinders 50 the defined pressing force can be applied onto the driving material.

In FIGS. 8 to 10 an alternative embodiment of a pile-driving device 10 according to the invention is shown, in which a pile-driving power unit 20 with a base frame 21 is freely suspended by means of a crane hook 17 and a support rope 15.

To erect the driving material 5, which is a sheet pile in the embodiment, the flexible securing element 30 is initially guided through a securing hole 6 while the driving material 5 is in a horizontal position. The flexible securing element 30, which is a steel rope in the embodiment, is fixed with its two ends on a receiving part 22 of the pile-driving power unit 20. The driving material 5 can now be hoisted into a vertical by pulling up the pile-driving power unit 20 by means of the crane hook 17, which is fixed on a crane, in particular a crawler crane, until the driving material 5 rests vertically on the ground. In this state a bracket-shaped pressing element 42 of a pressing unit 40 can then be moved downwards from a withdrawn position on the pile-driving power unit 20. This can be effected by means of two lateral positioning cylinders 50 that are arranged between the base frame 21 and the pressing element 42.

In doing so, contact sections 43 supported in a transversely shiftable manner on the underside of the pressing element 42 come into contact with a front face 7 of the driving material 5 and thereby press the driving material 5 with a defined force against the ground. This ensures a reliable positional securing or tilt protection of the driving material 5 irrespective of a lateral outer contour, as illustrated in FIG. 8. To accomplish reliable reception of the driving material 5 in the receiving part 22 by a clamping means 24 the contact sections 43 can be displaced substantially horizontally by a certain amount in order to align the front face 7 of the driving material 5 towards the receiving part 22.

According to FIG. 9, with the pressing element 42 still abutting against the front face 7 of the driving material 5, the receiving part 22 can then be moved towards the driving material 5 through retraction of the positioning cylinders 50 along with a simultaneous lowering of the crane hook 17, whereby the front face 7 of the driving material 5 is received in the receiving part 22 between the clamping jaws of the hydraulic clamping means 24, as illustratively depicted in FIG. 9. In this state the received driving material 5 can then be firmly clamped on the pile-driving power unit 20 by closing the clamping means 24.

Before commencement of the actual pile-driving process the positioning cylinders 50 are retracted further, whereby the pressing element 42 reaches a withdrawn position, in which the contact sections 43 are spaced apart from the front face 7 of the driving material 5. To achieve sufficient advancing force a corresponding superimposed load can be provided on the base frame 21 of the pile-driving power unit 20. Due to the overall weight of the pile-driving power unit 20 in combination with the generated vibratory movement the driving material 5 can thus be driven into a ground.

The invention claimed is:

1. Pile-driving device for driving a driving material into a ground, having a pile-driving power unit which is arranged in a vertically movable manner and has means for clamping and holding the driving material, a flexible securing element with which the driving material can be connected to the pile-driving power unit prior to clamping, and a pressing element supported in a displaceable manner relative to the pile-driving power unit for applying a pressing force vertically downward onto an upwardly-facing surface of a top edge of the driving material prior to clamping.

2. Pile-driving device according to claim 1, wherein the pressing element has a passage through which clamping of the driving material by the means for clamping is enabled when the pressing element is in abutment.

3. Pile-driving device according to claim 1, wherein the pressing element is of fork-shaped design.

4. Pile-driving device according to claim 1, comprising a positioning cylinder which is arranged between the pile-driving power unit and the pressing element for displacing the pressing element.

5. Pile-driving device according to claim 1, wherein the pressing element is displaceable along a linear guide which is arranged on a mast or the pile-driving power unit.

6. Pile-driving device according to claim 1, wherein the pile-driving power unit is designed as a vibrator with rotatable imbalance elements or as a pile-driving hammer with a pulse element capable of being driven in a linearly reversible manner.

7. Pile-driving device according to claim 1, wherein a test unit is provided which is designed to establish if the flexible securing element is attached between the driving material and the pile-driving power unit.

8. Pile-driving device according to claim 1, comprising a mobile carrier implement on which the pile-driving power unit is arranged in a vertically movable manner, the mobile carrier implement having a carriage on a mast or having a support rope for moving the pile-driving power unit.

9. Method for driving or extracting driving material into or from a ground, the method comprising:

providing a pile-driving device wherein the driving material is clamped and held on a pile-driving power unit and the driving material is connected by a flexible securing element to the pile-driving power unit, and displacing a pressing element relative to the pile-driving power unit towards the driving material such that a vertically downward pressing force is applied onto an upwardly-facing surface of a top edge of the driving material.

10. Method according to claim 9, wherein the driving material is held by the pressing element in a clamping position, such that subsequently the pile-driving power unit is moved towards the driving material and the driving material is clamped and held on the pile-driving power unit for driving-in.

11. Method according to claim 10, wherein subsequently, for driving-in, the pressing element is released and spaced apart from the driving material.

12. Method according to claim 9, wherein by means of the pressing element a position of the driving material is adjusted and brought into a clamping position.

13. Method according to claim 9, wherein with pressing force being applied by the pressing element onto the driving material, the pile-driving power unit assumes a test position, in which the flexible securing element between the driving material and the pile-driving power unit is tensioned, and a test unit establishes if the flexible securing element is located between the driving material and the pile-driving power unit in the test position.

14. Method according to claim 13, wherein the test unit issues a warning signal if it is established that no flexible securing element is located between the driving material and the pile-driving power unit.

15. Method according to claim 14, wherein the test unit prevents clamping, driving-in or extraction of the driving material if it is established that no flexible securing element is located between the driving material and the pile-driving power unit.

16. Method according to claim 13, wherein the test unit prevents clamping, driving-in or extraction of the driving material if it is established that no flexible securing element is located between the driving material and the pile-driving power unit.

* * * * *